United States Patent [19]

Littleton

[11] Patent Number: 4,774,771

[45] Date of Patent: Oct. 4, 1988

[54] SELF CLEANING CHILL ROLL APPARATUS

[75] Inventor: Francis J. Littleton, Alden, N.Y.

[73] Assignee: Littleton Industrial Consultants, Inc., Alden, N.Y.

[21] Appl. No.: 28,716

[22] Filed: Mar. 20, 1987

[51] Int. Cl.[4] ..... F26B 13/08

[52] U.S. Cl. ..... 34/62; 34/66; 34/113

[58] Field of Search ..... 34/13, 62, 66, 116, 34/117, 119, 113

[56] References Cited

U.S. PATENT DOCUMENTS 1,144,896 6/1915 Fusbraey ..... 34/62
4,476,636 10/1984 Gross ..... 34/114

OTHER PUBLICATIONS

Crossroads Press, P.O. Box 929, Effingham, Ill., dated approx. 1983.

Arcata Graphics, 2475 George Urban Blvd., De Pue. N.Y., 14043, dated prior to 1983.

*Primary Examiner*—Larry I. Schwartz
*Attorney, Agent, or Firm*—Neuman, Williams, Anderson & Olson

[57] ABSTRACT

An apparatus for cooling and setting ink to a web of paper through a series of chill rolls which are arranged such that both sides of the web are cleaned while traveling through the chill rolls and maximum wrap efficiency is obtained. As the web travels from the oven it passes through a series of chill rolls arranged in an upside mode in which a number of the middle chill rolls are mounted on vertically adjustable shafts so that barrier layers which build up on the web can be brought together and scrubbed as they cross in opposite directions on both sides of the web. The placement of the middle chill rolls on adjustable shafts also permits a more efficient wrap of the web around the chill rolls to promote more efficient cooling of the web.

20 Claims, 4 Drawing Sheets

FIG. 2
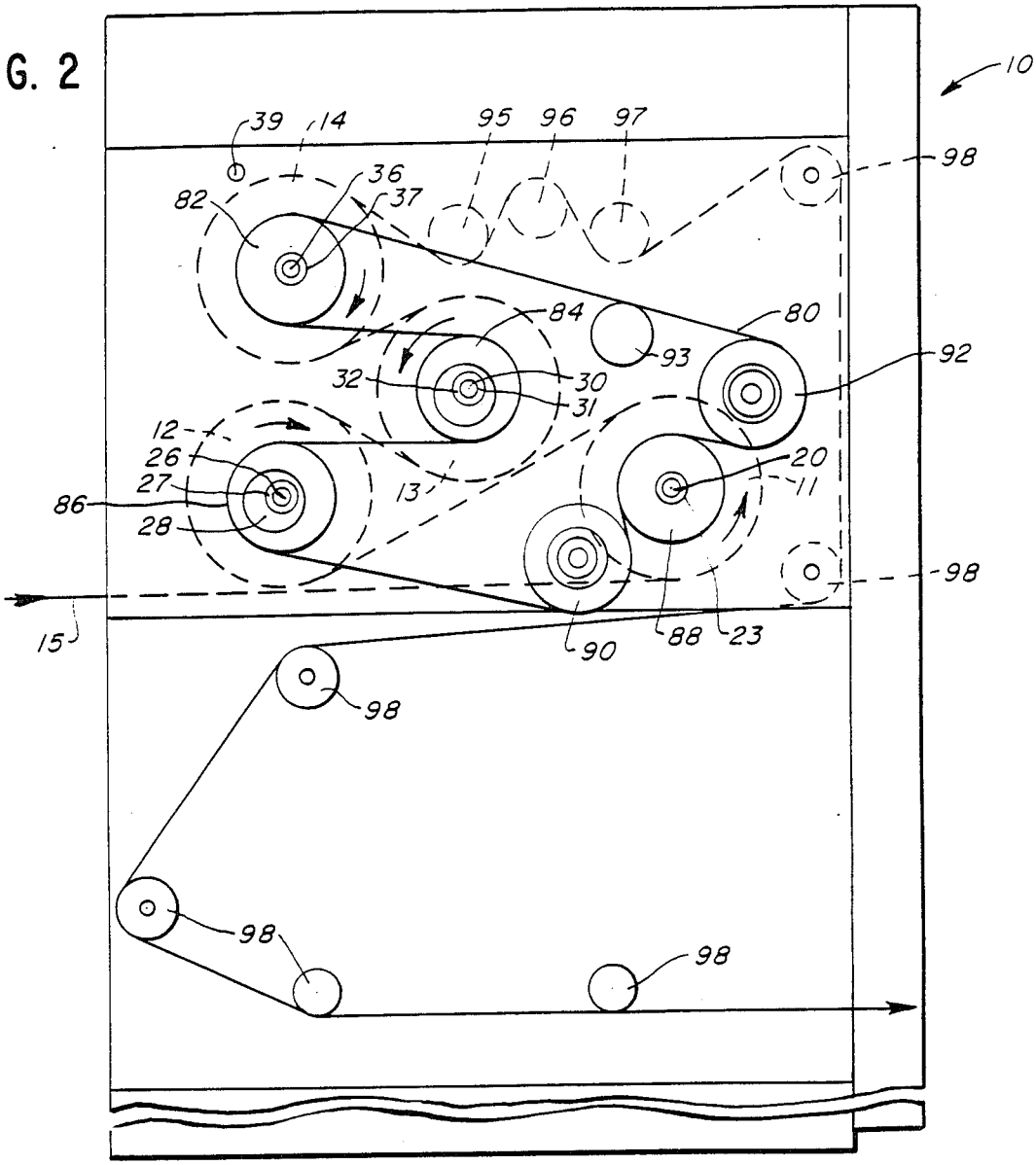
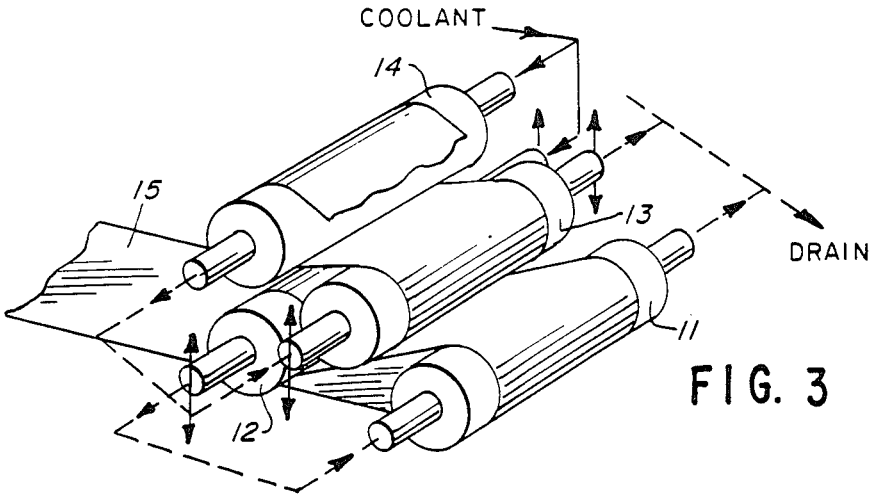
FIG. 3

SELF CLEANING CHILL ROLL APPARATUS

BACKGROUND OF THE INVENTION

Field of Invention

The present invention relates to an improved chill roll apparatus for setting ink to a web of paper. Typically, in a web fed printing press, a continuous sheet or web of paper exits the printing press and is then subject to a tension control unit and a web aligner. Next, the web is passed through an oven to remove or drive off the chemical solvents from the ink. However, the elevated temperature of the oven prevents the ink from drying on the web so the web is then passed through a series of chill rolls to cool the web and to set the ink to the paper. Subsequently, the web is fed to a slitter or cutter for further processing.

A basic chill roll apparatus consists of a series of rollers, typically four, arranged in a stacked offset manner beneath the plane of the web. The web serpentinely traverses its way around the chill rolls in order to cool the web and set the ink to the paper. A coolant, such as water, is circulated through the chill rolls to constantly supply the chill rolls with a fresh supply of coolant. The path of the coolant further includes some type of heat exchanger to rejuvenate and recool the heated coolant after it passes through the chill rolls.

In a conventional chill-roll apparatus the solvents inks and printing resins or printing residue used and produced in the printing process can attach to and build up on the chill rolls themselves. This problem is created by a layer of air, containing the solvents and residue, forming on the upper and lower surfaces of the web and becoming trapped between the web and the chill rolls thereby allowing the solvents and residue to transfer onto the chill roll. When the printing residue collects on the chill rolls, the residue is transferred back to the web and marks or smears the freshly printed web. By either significantly reducing the barrier or boundary layer of air which has formed on the web or by removing the solvent fumes, inks and printing residue from this barrier layer, the printing residue cannot attach to the chill rolls and cannot ruin the printed web.

The oven is used to drive off the wet solvents and resins from the inks used during the printing process. The heated environment causes the solvents and resins to evaporate and lift off the face of the web. However, as the web of paper travels from the oven to the chill rolls, a barrier or boundary layer of air attaches to both surfaces of the web. The creation, existence and size of the barrier layer is a function of the web speed and tension and the type of paper being employed. The faster the web moves or the less the tension of the web, the larger the barrier layer grows and the greater adherence it has to the web. Consequently, as the web travels through the oven and the solvents, resins and printing residue lift off the web, the barrier layers of air become impregnated with the solvents and residue.

In a conventional chill roll apparatus, after the heated web leaves the oven, the web typically travels a short horizontal distance to a first chill roll and wraps downwardly around this chill roll. While the arrangement of chill rolls may either be above or below the plane of the web exiting oven, for illustrative purposes, a conventional chill roll apparatus will be described herein as having the series of chill rolls disposed below the plane of the web. Because the barrier air surrounding the web is at an elevated temperature, as the web exits the oven into ambient air, the solvent laden warmer barrier layer lifts off the top of the web and is replaced by cleaner ambient air. However, the barrier layer of air which has attached to the bottom or underneath side of the web is prevented from rising by the web itself and, therefore, the lower barrier layer becomes trapped between the web and the chill roll as the web wraps downwardly around the first chill. The trapped barrier layer then transfers the ink solvents and other trapped printing residue onto the chill roll which, in turn, transfers this ink residue back to the web causing marking or smearing on the printed web.

Various types of chill roll apparatuses for setting ink to the web are presently used. The conventional method of chilling a web makes use of four chill rolls, arranged in a stacked offset grid. The web traverses the grid of chill rolls so that both surfaces of the web alternately contact the chill rolls in order to achieve chilling of the web. Generally, the web travels from the oven and wraps over the top of the first chill roll so that the underneath side of the web is in contact with the chill roll. As explained above, the barrier layer adhering to the lower surface of the web is prevented from naturally dissipating as a result of the position of the overlying web and the barrier layer becomes trapped between the web and the first chill roll as the web traverses the chill roll. After passing over the first chill roll, the web is fed downwardly to the second chill roll disposed beneath the first chill roll. The web wraps around the second chill roll so that the top surface of the web is now in contact with the chill roll rather than the bottom surface. Even though the heated barrier layer on the top of the web could rise off the surface of the web after exiting the oven, due to the speed or tension of the web a solvent laden barrier layer of air still adheres to the upper surface of the web. As a result, this solvent layer becomes trapped between the upper surface of the web and the second chill roll. The web is then fed diagonally upwardly to the third chill roll disposed in a plane slightly below the first chill roll. In wrapping around the third chill roll the lower surface of the web engages the surface of the chill roll and the barrier layer which is adhering to the lower surface becomes trapped between the lower surface of the web and the third chill roll. The web is then finally fed downwardly to a fourth chill roll disposed beneath the third chill roll so that the upper surface of the web contacts the chill roll. Here, as with the other chill rolls, the barrier layer adhering to the web becomes trapped between the web and the chill roll.

The inherent problem in such conventional methods is that the solvent laden barrier layer adhering to either side of the web becomes trapped at the nip formed where the web wraps around each chill roll and, as a result, the solvents and ink resins suspended in the barrier layers transfer to the surface of the chill rolls. Consequently, as the web continuously travels through the chill roll apparatus, the ink residue on the chill rolls marks and smears subsequent portions of the web and subsequent sections of residue laden barrier layers continue to deposit ink residue on the surfaces of the chill rolls. As can be seen, this is a self perpetuating problem which can potentially ruin an entire printed web of paper causing substantial waste and expense.

In an effort to solve this problem, other prior art devices have added a tunnel extending from the oven to the first chill roll to assist solvent disbursement. By maintaining the oven at a decreased pressure, in comparison to the ambient air outside the oven, a suction is created which draws external ambient air into the tunnel in a direction opposite to the movement of the web and any barrier layer which may have formed. Unfortunately, this method, at best, is only effective in minimally reducing the solvent laden barrier layer and does not significantly eliminate the solvent laden barrier layer.

Still further prior art systems disclose a fan for blowing air across the web as it comes out of the oven in an attempt to dissipate the solvent laden barrier layer or to replace the suspended solvents and resins in the barrier layer. Such ventilating systems are less efficient as the speed of the web is increased. The inherent problem with such a fan system is that the fan has to be very powerful and, consequently, expensive in order to overcome the adherence of the barrier layer to the web.

In another prior art apparatus, the chill rolls are arranged above the plane of the web rather than below and are located a further distance from the oven. The longer travel distance from the oven to the first chill roll works to decrease the solvent in the barrier layer on the top of the web by providing a longer time for the barrier layer to naturally dissipate. Moreover, because the web then wraps upwardly around the first chill roll, the barrier layer which has formed to the bottom of the web undergoes some natural dissipation as the web turns upward to wrap around the first chill roll. However, this natural dissipation is not effective enough in significantly reducing the barrier layer.

A still further improvement of this system over previous methods mounts the four chill rolls in a frame which pivots about the axis of the first chill roll. The pivoting action allows the second chill roll to be placed closely adjacent and in overlying registration with the web travelling to the first chill roll from the oven. Because the rotation of the second chill roll is in a direction opposite that of the web travelling from the oven to the first chill roll, the barrier layer adhering to the top surface of the web exiting the oven may be subjected to the opposing movement of the web traversing the second chill roll in the opposite direction depending upon placement of the second chill roll. As best understood, this opposing motion causes the barrier layer adhering to the web to be reduced in size.

In spite of these improvements, this method does not effectively solve the solvent and resin laden barrier layer problem. In this last described apparatus, only the barrier layer on the top surface of the web is subject to cleaning. The barrier layer that is formed on the bottom of the web and subsequently trapped between the web and the second chill roll is not acted upon at any time. Instead this bottom barrier layer is subject only to natural dissipation. Consequently, at least two of the four chill rolls still become marked and the bottom portion of the web is continuously subjected to these marked rollers. Moreover, it is possible that the opposing action of the web traversing the second chill roll and the web travelling to the first chill roll is insufficient to effectively remove the barrier layer. Significant solvents and residue may remain and adhere to the first chill roll and subsequently ruin the other side of the web as well. This results in just as much waste as if the entire web were ruined.

The pivoting frame also gives rise to a further problem. As the chill roll frame is rotated about the first chill roll to position the second chill roll further from the surface of the web exiting the oven, the wrap of the web about the first chill roll is decreased. Decreased contact with the chill rolls reduces the cooling effectiveness of the apparatus.

The present invention overcomes the problems and limitations associated with these prior systems by employing a chill roll apparatus in which the second and third chill rolls are mounted on adjustable shafts or eccentrics such that both the second and third chill rolls can be positioned to scrub or clean the residue laden barrier layers of air on both sides of the web. While applicant understands the result of this scrubbing is to significantly reduce the barrier layers, thereby reducing the amount of solvents and ink residue, testing and experimentation has proved inconclusive except for the fact that ink buildup on the rollers and subsequent smearing of the web is drastically reduced. It is also possible that instead of reducing the barrier layers, the scrubbing removes the solvent and ink laden air and replaces it with clean ambient air. The resulting effect of reducing buildup on the chill rollers would be the same.

Because the second and third chill rolls are adjustably positionable, both vertically and horizontally, the second chill roll can be positioned essentially in contact with the web travelling from the oven to the first chill roll. In this manner, maximum wrap of the web about the first chill roll is achieved. Similarly, by lowering the third chill roll closer to the web travelling between the first and second chill rolls, maximum wrap of the web about the second chill roll is achieved. Clearly, as greater surface contact between the web and the chill rolls is achieved, the cooling efficiency of the chill roll is increased thereby providing better setting of the ink to the web.

The vertical adjustability of the second and third chill rolls also allows the operator to vary the degree or amount of scrubbing. Rather than positioning the second and third chill rolls adjacent and slightly above the portions of the web to be scrubbed, wherein the amount of effective scrubbing would be limited, the second and third chill rolls can be positioned so that the two portions of web involved are in contact. As a result, an increased zone of interference or scrubbing is created which increases the scrubbing efficiency of the present invention and, additionally, achieves greater web wrap efficiency and cooling.

OBJECTS OF THE INVENTION

It is a general object of this invention to provide an improved means for cooling and setting ink on paper for use in connection with printing processes.

It is a further object of this invention to provide an improved chill roll apparatus for use in connection with printing processes.

It is another object of this invention to provide an improved chill roll apparatus which either substantially reduces the solvent and ink laden barrier layers of air attaching to a continuous web of paper or substantially removes the suspended printing solvents and ink residue from the barrier layers, thereby cleaning the barrier layers of air attaching to a continuous web of paper.

It is another object of the present invention to provide an improved chill roll apparatus which prevents the transfer of ink solvents and resins to the chill rolls.

It is still another object of this invention to provide an improved chill roll apparatus which provides a greater wrap of the web about the chill rolls to more efficiently and effectively set the ink on the continuous web of paper.

Other objects and advantages of the invention will become apparent upon reading the following detailed description and appended claims, and upon reference to the accompanying drawings.

IN THE DRAWINGS

For a more complete understanding of this invention, reference should now be made to the embodiment illustrated in greater detail in the accompanying drawings and described below by way of examples of the invention.

FIG. 2 is a side view of the apparatus of the present invention taken along line 2—2 of FIG. 1.

FIG. 3 is a partial perspective view of the chill rolls and continuous web of the present invention.

Figure 1:
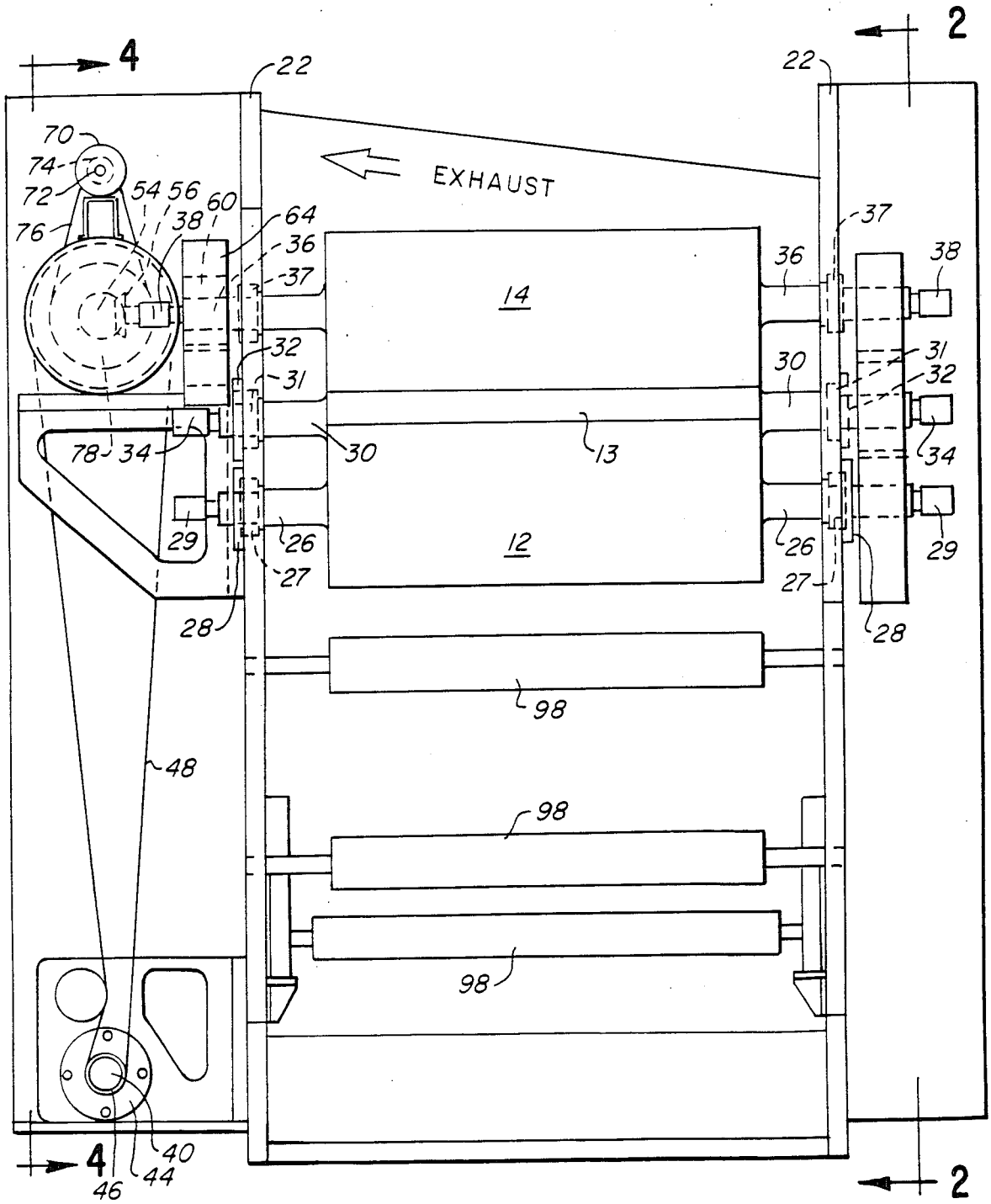
FIG. 1 is a front view of the apparatus of the present invention.

It should be noted, of course, that the invention is not necessarily limited to the particular embodiments illustrated herein and that rather than removing the barrier layers of air, the scrubbing of the present invention may remove the ink solvents and printing residue from the barrier layers and replace it with clean ambient air.

SUMMARY OF THE INVENTION

In the preferred embodiment, a continuous web of paper, having been subjected to a printing process, travels through an oven to dissipate the solvents, inks and printing resins or printing residue adhering to the web as a result of the printing process. As the web travels through the oven and subsequently to the chill rolls, a boundary or barrier layer of air forms and adheres to each side of the web. This barrier layer is laden with solvent fumes, inks and printing residue from the printing process which are evaporating from the surface of the web as a result of the heated environment in the oven. The elevated temperatures also prevent the ink from drying on the web so the web must be subsequently cooled in order to set the ink to the web. Typically, a chill roll apparatus performs this task.

The web is received in the chill roll apparatus by a first chill roll and wraps upwardly around the roll until it reverses direction and travels back toward the oven. The web then wraps upwardly around a second chill roll disposed closer to the mouth of the oven. The second chill roll is adjustably mounted to the apparatus and is positioned in an overlying relationship with the portion of the web exiting the oven and travelling to the first chill roll. Consequently, an area or zone of interference can be created between the portion of the web below the second chill roll exiting the oven and the portion of the web traversing the second chill roll by positioning the second chill roll closely adjacent the web exiting the oven and travelling to the first chill roll. Because these two portions of the web are travelling in opposite directions, it is believed that the opposed movement of the web and barrier layers creates a zone or area of interference which substantially removes or reduces the interfering barrier layers which are adhering to the web. However, rather than actually remove or reduce the barrier layers, it is possible that the interference created by the opposed barrier layers may cause the solvent fumes, inks and printing residue suspended in the barrier layers to be replaced by clean ambient air without actually removing the barrier layers. The result is the same in either event; the ink solvents and printing residue are significantly prevented from adhering to the chill rolls and smearing the printed web.

For the purposes of the present application, the preferred embodiment of the invention will be described in the context of removing or reducing the barrier layer. Nevertheless, the scope of the invention includes the replacement of the ink solvent and printing resin laden barrier layers with barrier layers containing only clean air.

The adjustable mounting of the second chill roll to the frame allows for both vertical and horizontal positioning of the second chill roll. This adjustability allows the amount of interference between the opposed portions of the web to be varied. In the preferred embodiment the chill roll will be eccentrically mounted. As a result, greater scrubbing of the barrier layers will occur when the second chill roll is brought closer to the underlying portion of the web travelling from the oven to the first chill roll.

After traversing the second chill roll, the web again reverses direction and wraps upwardly around a third chill roll, which is rotating in the opposite direction of the second chill roll. The third chill roll is positioned above and offset from the first chill roll. The third chill roll is similarly mounted on an adjustable shaft or eccentric so that it may be vertically and horizontally positioned to provide variable scrubbing of the upper surface of the web travelling between the first and second chill roll by the portion of the web travelling in the opposite direction about the third chill roll. The degree of scrubbing that is achieved between these opposing portions of the web is regulated by the positioning of the third chill roll. The web surface being scrubbed here is the opposite side of the web surface scrubbed by the action of the web traversing the second chill roll. In this way, both sides of the web are effectively scrubbed to remove the barrier layers of air containing the solvents and ink residue.

DETAILED DESCRIPTION

The relationship and workings of the various elements of this invention will be better understood by the following detailed description. However, the embodiment of the invention described below is by way of example only and applicant does not limit himself to this embodiment. Furthermore, one should understand that the drawings are not to scale and that the embodiments are illustrated by graphic symbols and fragmentary views. In certain instances, the applicant may have omitted details which are not necessary for an understanding of the present invention such as conventional details of fabrication and assembly.

Generally, the device of this invention sets ink to a web of paper and is intended to be integrated into a full service printing system. The present invention will follow the actual printing operation and will receive a continuous web of paper for chilling or cooling. Subsequent to chilling, but not part of this invention, the web would generally pass to a slitter or cutter for further processing of the web into a final product.

Described in more detail, a continuous web of paper, after being subjected to a printing process and subsequently run through an oven to evaporate the chemical solvents and resins used during printing, exits the oven and is fed into the chill roll apparatus 10 of the present invention. A series of driven chill rolls 11, 12, 13 and 14, pull the web 15 through the apparatus. The chill rolls are arranged in an offset grid pattern and the continuous web serpentinely traverses these chill rolls in order to achieve contact between both sides of the web 15 and the chill rolls. As shown in FIG. 3, a coolant circulates through the chill rolls to provide the necessary cooling for setting the ink on the web.

Figure 6:
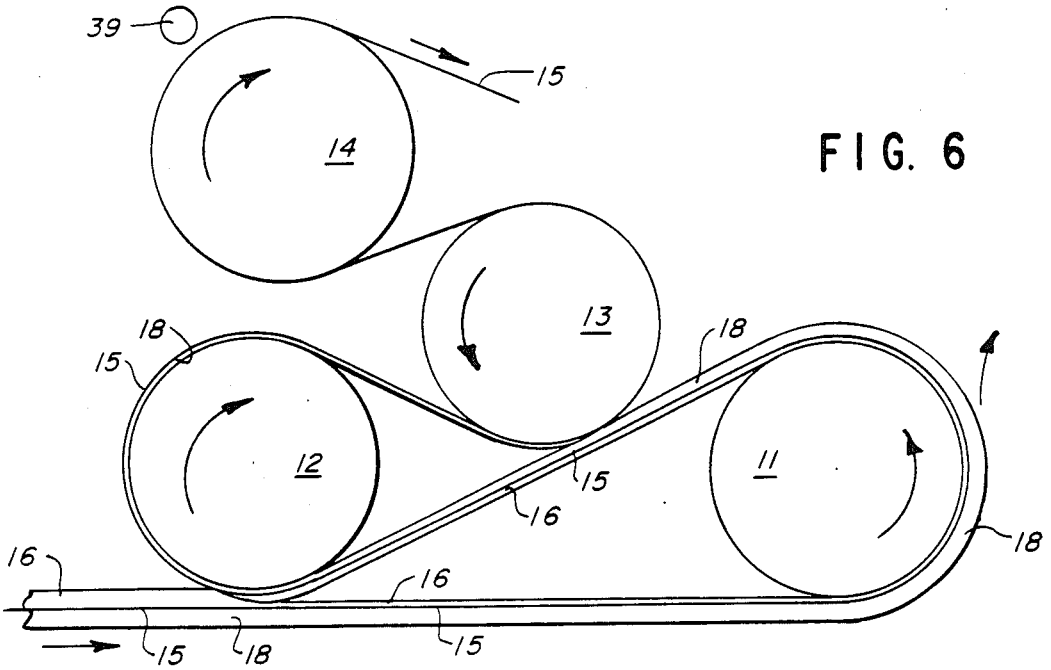
FIG. 6 is a cross-sectional view of the chill rolls and web of the present invention showing the understood manner in which the interference or the scrubbing significantly removes the barrier air layers.

As graphically seen in FIG. 6, as the web 15 exits the oven, two barrier layers of air 16 and 18 have attached to the upper and lower surfaces of the web, respectively. These barrier layers contain suspended amounts of chemical solvents, printing ink resins and solvent fumes which have been caused to evaporate from the surfaces of the web and become trapped in the barrier layers of air as a result of the heated environment in the oven. After leaving the oven, the web 15 travels a distance and enters the chill roll apparatus 10. Therein, the web 15 is received by a first chill roll 11. This first chill roll 11 is mounted on a hollow axle 20 rotatably mounted in the frame 22 by a pair of axle bearings 23. A pair of couplings (not shown) are affixed at each end of the axle 20 to provide attachment of coolant hoses for circulating the liquid coolant through the chill roll.

Figure 4:
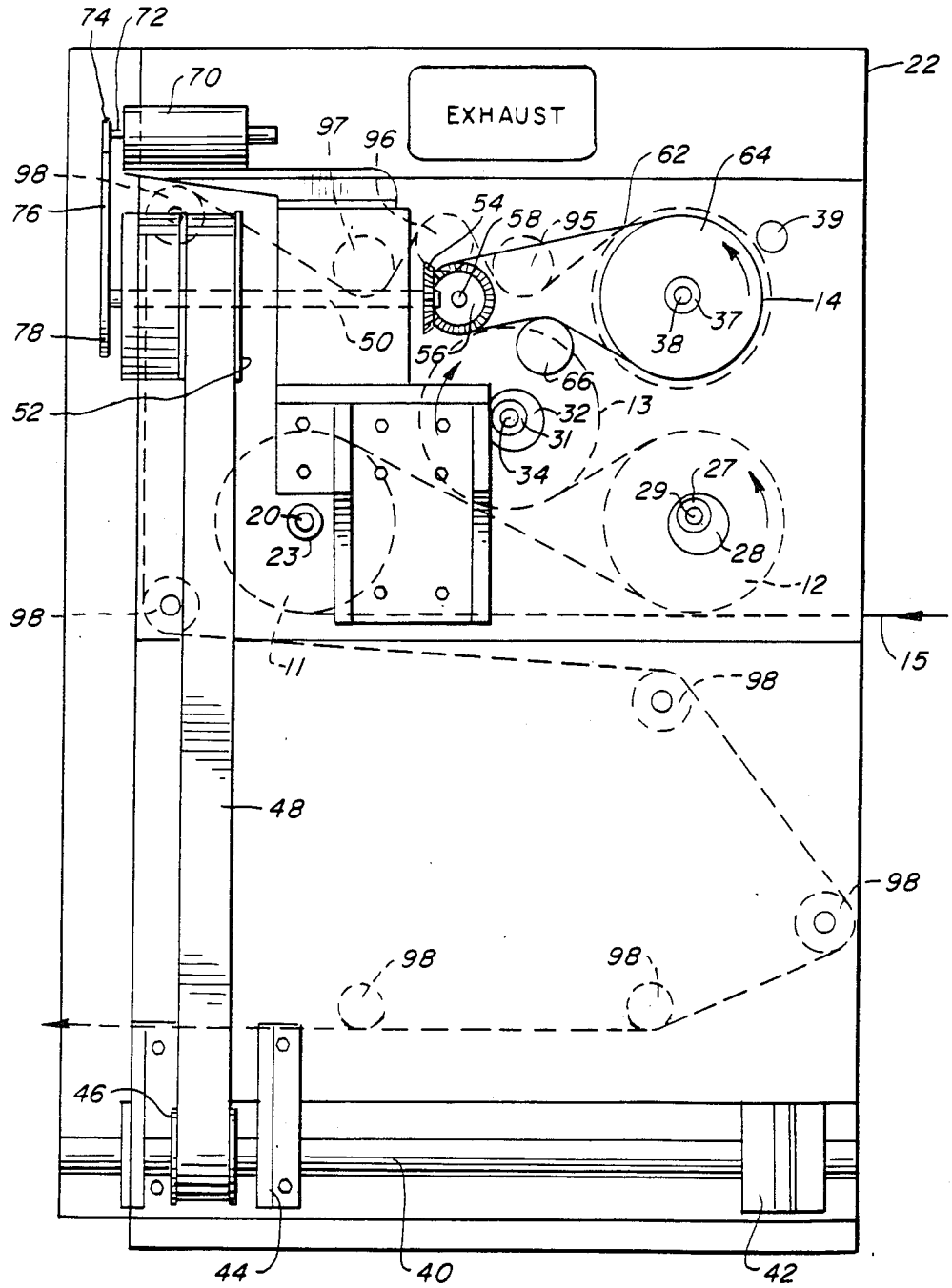
FIG. 4 is a side view of the apparatus of the present invention taken along line 44 of FIG. 1.
Figure 5:
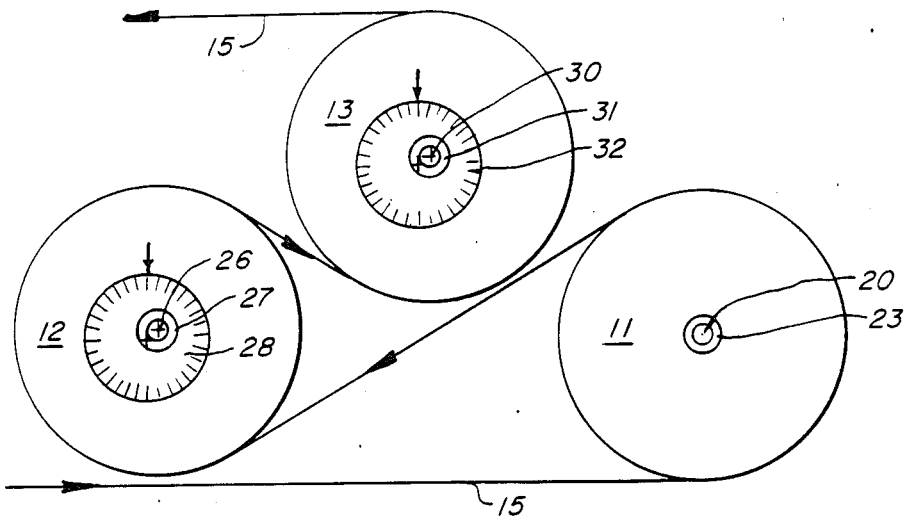

As can be seen in FIGS. 2, 4 and 5, after traversing the first chill roll 11, the web reverses direction and wraps upwardly around a second chill roll 12. The second chill roll 12 is mounted on a hollow axle 26 rotatably mounted in the frame 22 by a pair of axle bearings 27. However, unlike the first chill roll 11, the second chill roll is adjustably mounted in the frame 22 thereby allowing both vertical and horizontal positioning of the second chill roll.

The second chill roll 12 is mounted on a hollow axle 26 rotatably mounted in an axle bearing 27 which is mounted off center on an eccentric 28. The eccentric 28 is mounted within the side wall of the frame 22 to allow the eccentric to rotate and thereby provide both horizontal and vertical adjustability to the second chill roll 12. The eccentric is locked in place by means well known in the art when the apparatus is in operation. Additionally, as seen in FIG. 5, the third chill roll is mounted in the same manner and the perimeter edge of each eccentric is further provided with a scale to coordinate adjustment of the chill rolls. Each end of each chill roll must be adjusted the same or the apparatus will not function properly. Also, as shown in FIG. 1, a pair of couplings 29 affixed to the ends of the axles 26 to provide for attachment of coolant hoses.

As readily can be seen in FIGS. 2, 4 and 6, the second chill roll 12 is positioned in an overlying relationship with the portion of the web 15 travelling from the oven to the first chill roll 11. As a result of this positioning, the barrier layer 16 which has formed on the top surface of the web is subject to the scrubbing action of the second chill roll 12 which is rotating in the opposite direction of the web exiting the oven. This creates a self scrubbing action or zone of interference which significantly reduces and may completely remove the solvent laden barrier layer of air 16.

Figure 7:
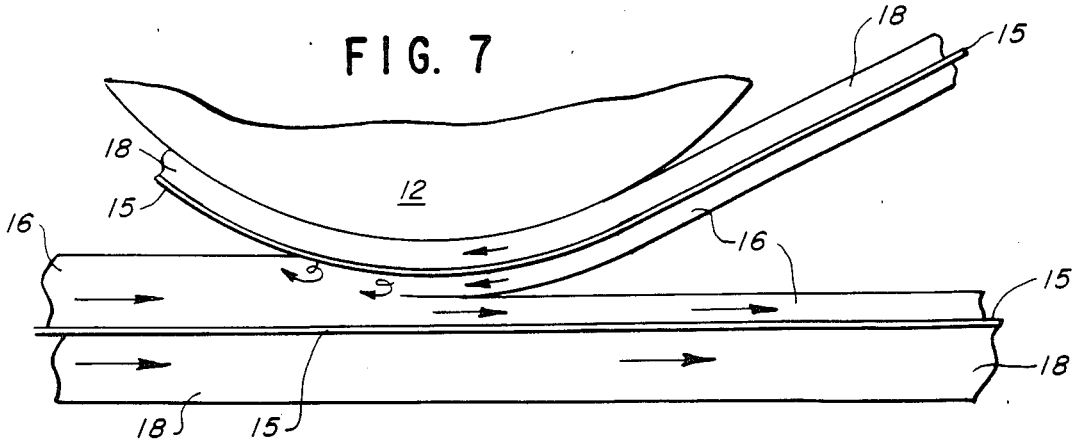
FIG. 7 is an exploded partial view of the understood manner in which the interference or the scrubbing removes the barrier layers of air from the web.

After passing the first zone of interference or scrubbing created by the placement of the second chill roll 12 seen in FIG. 7, some portion of the barrier layer 16 may remain adhered to the upper surface of the web 15 despite the scrubbing action of the web traversing the second chill roll 12. This barrier layer 16 becomes trapped between the upper surface of the web and the surface of the first chill roll 11 as the web traverses the chill roll 11. However, because the barrier layer 16 has been subjected to scrubbing, the barrier layer and concomitantly the ink residue suspended in the barrier layer have been reduced and any potential buildup of solvents and resins on the first chill roll which could subsequently ruin the printed web is substantially prevented.

After traversing the first chill roll, the path of the web reverses as the web travels to the second chill roll 12. If any barrier layer 16 has survived the first zone of interference it is now on the exterior of the web as the web travels back to the first zone of interference and wraps around the second chill roll 12. Consequently, and by design, this barrier layer 16 is itself subject to scrubbing by the barrier layer 16 adhering to the top surface of the web 15 as it leaves the oven. Optimally, after the web has reached the second chill roll 12 and has again passed the first area of scrubbing, the solvent and residue laden barrier layer which had adhered to the top surface of the web as it exited the oven has been significantly if not completely removed.

Of course, if the barrier layer 16 had been completely removed from the web 15 as it travelled from the oven to the first chill roll 11 and through the first zone of interference, there would not be a barrier layer adhering to the exterior of the web traversing the second chill roll 12. In this case, the web itself, rather than the barrier layer, can coact with the barrier layer 16 adhering to the top of the web exiting the oven to create the scrubbing action or zone of interference to remove the barrier layer from the web.

Although the barrier layer 16 has now been effectively removed, the barrier layer 18 which adheres to the bottom surface of the web exiting the oven still remains. This barrier layer is removed in the same manner as was the barrier layer 16 adhering to the upper surface of the web.

As seen in FIGS. 2, 4 and 5, the bottom surface of the web has a solvent and ink residue laden barrier layer of air 18 adhering to it as it exits the oven. At this point, the barrier layer 18 is essentially the same size as the barrier layer 16 adhering to the top surface 16 of the web. While the barrier layer 16 adhering to the top surface of the web is subject to natural dissipation, the presence of the web 15 blocks any significant portion of the barrier layer 18 adhering to the bottom surface of the web from naturally dissipating into the surrounding, cooler air. However, as the web 15 wraps upwardly around the first chill roll 11, natural heat dissipation does occur and the barrier layer 18 may be reduced depending upon the speed of the web. As the web moves faster through the apparatus the effects of natural dissipation of the barrier layer will be decreased. Unfortunately, the effects of natural dissipation are usually minimal because of the desirability to operate the entire printing process, including the chill roll apparatus, as fast as possible in order to maximize product production and output.

As the web travels from the first chill roll 11 to the second chill roll 12, a second zone of interference or scrubbing can be created as a result of the positioning of the third chill roll 13. The third chill roll 13 receives the web 15 exiting the second chill roll 12 and this portion of the web is travelling in the opposite direction of the web moving from the first chill roll 11 to the second chill roll 12. As with the second chill roll 12, the third chill roll 13 is mounted on a hollow axle 30 rotatably mounted in a pair of axle bearings 31 which are mounted off center on an eccentric 32. The eccentric 32 is mounted within the side wall of the frame 22 to allow the eccentric to rotate and provide vertical and horizontal adjustability to the third chill roll 13. Additionally, a pair of couplings 34 are affixed to the end of the axle 30 to provide for attachment of cooling hoses.

The barrier layer 18 adhering to the upper surface of the web travelling from the first chill roll 11 to the second chill roll is subject to cleaning or removal by the scrubbing action of the web traversing the third chill roll 13. As can be seen in FIG. 6, the barrier layer 18 adhering to the web travelling between the first and second chill rolls passes through the second zone of scrubbing and is forced between the web 15 and the second chill roll 12. Any portion of the barrier layer 18 which was not removed will then be subject to scrubbing as the web travels to the third chill roll 13 and again passes through the second zone of scrubbing. As a result, the barrier layer 18 is significantly if not completely eliminated by the time the web 15 wraps upwardly about the third chill roll 13.

Thus, it is understood that the problem of solvents and ink resins being transferred from the barrier layers 16 and 18 to the surfaces of the chill rolls and then subsequently transferred back to the web has been avoided. The scrubbing or interference zones created by the positioning of the second and the third chill rolls 12 and 13 effectively and significantly reduce the amount of the barrier layer which is trapped between the web and the first and second chill rolls 11 and 12. Moreover, the areas of scrubbing effectively, if not totally, eliminate the solvent laden barrier layers adhering to both surfaces of the web before the web reaches the third chill roll 13. Any barrier layers that may remain have been effectively removed or reduced to the point that all of the chill rolls are effectively free of any solvents or ink residue.

While the barrier layers have been effectively removed, in the preferred embodiment, the process may not be complete after the web has exited the third chill roll 13. The web may still need further cooling in order to properly set the ink to the web. As can be seen in either FIGS. 2, 4 or 5, after exiting the third chill roll 13, the web again reverses direction and wraps upwardly around the fourth and final chill roll 14. The fourth chill roll 14 rotates about a hollow axle 36 mounted to the frame 22 in axle bearings 37 and is not adjustably positionable. Both ends of the axle 36 are provided with couplings 38 to allow attachment of liquid coolant hoses. Additionally, a trolley roller 39, spring loaded and rotatably mounted to the frame is employed to maintain the web in contact with the fourth chill roll 38. This ensures that the web is travelling at the same speed as the chill rolls.

While three chill rolls may be sufficient to cool the web in many instances, the preferred embodiment of the present invention incorporates a fourth chill roll 14 to ensure that both surfaces of the web have contacted at least two chill roll surfaces. The top surface of the web contacts and is cooled by the first and third chill rolls 11 and 13, and the bottom surface of the web contacts and is cooled by the second and fourth chill rolls 12 and 14. While the fourth chill roll 14 plays no role in the removal of the barrier layers of air, it does ensure that the bottom surface of the web is sufficiently cooled. It should be understood that the actual number of chill rolls used may vary.

The present invention further ensures proper cooling of the web by maximizing the amount of contact the web 15 has with the chill rolls as a result of the vertical adjustability of the second and third chill rolls 12 and 13. As can be seen in FIGS. 2 or 4, the actual contact the web has with the first and second chill rolls 11 and 12 is a direct function of the vertical position of the second and third chill rolls 12 and 13. The lower the second and third chill rolls are positioned, the more contact the web has with the first and second chill rolls. Conversely, the higher the second and third chill rolls 12 and 13 are positioned, the less contact the web 15 will have with the first and second chill rolls 11 and 12. Consequently, by lowering chill rolls 12 and 13, the present invention maximizes both barrier layer removal and web cooling.

Turning now to the drive mechanism of the apparatus, all four chill rolls are driven in order to pull the web through the device. As seen in FIGS. 1 and 4, the entire chill roll apparatus receives its power from the printing press through drive shaft 40 rotatably mounted in bearing sleeves 42 and 44 affixed to the frame 22. A timing gear 46 is mounted to one end of the drive shaft 40 and rotates with the drive shaft. A timing belt 48 interconnects the drive shaft 40 to the chill roll drive shaft 50 by means of a timing gear 52 affixed to the chill roll drive shaft 50. The chill roll drive shaft 50 is mounted to the frame by means well known in the art.

As seen in FIG. 4, a right angle or bevel gear 54 is connected to the opposite end of the chill roll drive shaft 50. This bevel gear 54 engages and drives a complementary bevel gear 56 affixed to the end of an axle 58 rotatably mounted in the frame 22. A timing gear 60 is also mounted on this axle 58, FIG. 1, and drives a timing belt 62 which, in turn, drives a timing gear 64 affixed to the end of the axle 36 about which the fourth chill roll 14 rotates. This timing belt 62 is subject to common tensioning by means of an adjustable roller 66.

Additionally, a simple harmonic drive motor 70 is employed to ensure that the chill roll drive shaft 50 drives the chill rolls at the appropriate and correct speed. As seen in FIG. 4, the harmonic motor 70 is affixed to the frame 22 and has a drive shaft 72 which rotates a timing gear 74 affixed at its end. The timing gear 74 interconnects the simple harmonic motor 70 to the chill roll drive shaft 50 by means of a timing belt 76 and a timing gear 78 affixed to the end of the chill roll drive shaft 50. Consequently, the harmonic motor 70 can regulate the speed at which the chill roll drive shaft 50 rotates thereby regulating the speed of all four chill rolls.

The three remaining chill rolls are driven by means of a timing belt 80 interconnecting four timing gears disposed on similar ends of the chill roll axles. As seen in FIGS. 1 and 2, the fourth chill roll 14, which receives rotary power through the timing gear 64 disposed at one end of the axle 36, has a second timing gear 82 affixed to the opposite end of the axle 36. This timing gear 82, in turn, drives the three remaining timing gears by means of a timing belt 80. As shown in FIG. 2, the timing belt 80, circuitously makes its way about timing gear 84, affixed to the axle of the third chill roll 13, about timing gear 86, affixed to the axle of the second chill roll 12, and about timing gear 88, affixed to the axle of the first chill roll 11. Two idler timing gears 90 and 92 are necessarily employed to position the timing belt 80 to rotate the respective four chill rolls in the proper direction. These two idler gears 90 and 92 are affixed to the frame by means well known in the art. Additionally, a tensioning roller 93 is employed to provide adjustable tensioning to the timing belt 80.

Finally, after exiting the fourth chill roll 14, the web is subject to a series of tensioning and aligning rollers. As seen in FIGS. 2 and 4, the web traverses three rollers 95, 96 and 97 which supply the necessary tension to the web. Subsequently, the web then travels through a series of aligning rollers 98 which act to position the web to be received by the next apparatus to act on the web. As is known in the art, the aligning rollers are adjustable in order to adjust the position and placement of the web exiting the chill roll apparatus as needed.

While the above description only shows one embodiment of the invention, one will understand of course that the invention is not limited thereto since one may make modifications, and other embodiments of the principals of this invention will occur to those skilled in the art to which the invention pertains, particularly upon considering the foregoing techniques. For example, those skilled in the art will appreciate that the fourth chill roll may be adjustably mounted on an eccentric to provide a third zone of scrubbing and increased cooling as a result of longer web contact. Indeed, even more additional adjustably mounted chill rolls may be added in order to scrub each side of the web a fourth or fifth time. Moreover, the entire apparatus could be located below the plane of the web exiting the oven rather than above the web plane as shown and the apparatus need not be driven by the printing press but could employ an independent power source. Additionally, one skilled in the art will recognize that multiple methods exist for interconnecting and driving the four chill roll other than as described above.

It is therefore contemplated by the appended claims to cover any such modification and other embodiments as incorporate those features which constitute the essential features of this invention within the true spirit and scope of the following claims.

What is claimed is:

1. An improved chill roll apparatus used in connection with a process for setting ink to a web of paper by removing solvent fumes, inks and printing residue moving with said web in the barrier air layers of said web and cooling said web after ink and solvents have been applied to said web and subsequently heated, said apparatus comprising:

a frame;

a first chill roll mounted to the frame to receive the web;

a second chill roll mounted to the frame in an overlying relation to the web being received by said first chill roll, said second chill roll positioned so that said barrier layer of air adhering to the exterior surface of said web wrapping around said second chill roll coacts with the barrier layer of air adhering to the upper surface of said web being received by said first chill roll to create a zone of interference to significantly remove said solvent laden barrier layer of air adhering to the upper surface of the web being received by said first chill roll and any barrier layer remaining on said exterior web surface wrapping around said second chill roll;

a third chill roll mounted to the frame above said web travelling from said first chill roll to said second chill roll for receiving the web from said second chill roll, said third chill roll positioned so that the said barrier layer of air adhering to the exterior surface of said web wrapping around said third chill roll coacts with said barrier layer of air adhering to the upper surface of said web travelling in the opposite direction from said first chill roll to said second chill roll to create a zone of interference to significantly remove said solvent laden barrier layer of air adhering to the upper surface of said web travelling between said first chill roll and said second chill roll;

drive means mounted on said frame and associated with said chill rolls for rotating said rolls to cause said web to move through said apparatus in contact with said chill rolls; and, cooling means associated with said rolls for cooling said heated web to set the ink to said web.

2. The improved chill roll apparatus of claim 1 wherein said second and third chill rolls are adjustably mounted to said frame to provide vertical adjustable positioning of said chill rolls to thereby allow variable scrubbing and cleaning of said barrier layers and to further allow variable cooling of said web.

3. The improved chill roll apparatus of claims 1 or 2, further comprising a fourth chill roll mounted to said frame above the web travelling from said second chill roll to said third chill roll to receive the web from said third chill roll, said fourth chill roll positioned so that the web wrapping around said fourth chill roll coacts with the web travelling in the opposite direction from said second chill roll to said third chill roll to create a zone of interference to significantly remove said barrier layer of air containing said solvent fumes, inks and printing residue adhering to the upper surface of the web travelling between said second chill roll and said third chill roll.

4. The improved chill roll apparatus of claim 3 wherein said fourth chill roll is adjustably mounted to said frame to provide vertical positioning of said chill roll.

5. An improved chill roll apparatus used in connection with a printing process for setting ink to a web of paper by removing solvent fumes, inks and printing residue moving with said web in the barrier air layer of said web and cooling said web after ink and solvents have been applied to said web and subsequently heated, said apparatus comprising:

a frame;

a plurality of chill rolls mounted on said frame;

drive means mounted on said frame and associated with said rolls for rotating said rolls to cause said web to traverse a first chill roll, travel a distance to a second chill roll, traverse said second chill roll, travel a distance to at least a third chill roll, and traverse said third chill roll;

cooling means associated with said rolls for cooling said heated web to set the ink to said web; and a first and second scrubbing means for removing said solvent fumes, inks and printing residue suspended in said barrier layers adhering to said web;

said first scrubbing means defined by the interaction of said barrier layers adhering to said web traversing said second chill roll and said barrier layers adhering said web travelling to said first chill roll in the opposite direction;

said second scrubbing means defined by the interaction of said barrier layers adhering to said web traversing said third chill roll and said barrier layers adhering to said web travelling from said first chill roll to said second chill roll in the opposite direction.

6. The improved chill roll apparatus of claim 5 wherein said second and third chill rolls are adjustably mounted to said frame to provide vertical adjustable positioning of said chill rolls to thereby allow variable scrubbing and cleaning of said barrier layers and to further allow variable cooling of said web.

7. The improved chill roll apparatus of claim 5, further comprising a fourth chill roll mounted to said frame to receive said web after said third chill roll and a third scrubbing means for removing solvent fumes, inks and printing residue, said third scrubbing means defined by the interaction of said barrier layers adhering to said web traversing said fourth chill roll and said barrier layers adhering to said web travelling from said second chill roll to said third chill roll in the opposite direction.

8. The improved chill roll apparatus of claim 7 wherein said fourth chill roll is adjustably mounted to said frame to provide vertical positioning of said chill roll.

9. The improved chill roll apparatus of claim 6, further comprising a fourth chill roll mounted to said frame to receive said web after said third chill roll and a third scrubbing means for removing solvent fumes, inks and printing resins, said third scrubbing means defined by the interaction of said barrier layers adhering to said web traversing said fourth chill roll and said barrier layers adhering to said web travelling from said second chill roll to said third chill roll in the opposite direction.

10. The improved chill roll apparatus of claim 9 wherein said fourth chill roll is adjustably mounted to said frame to provide vertical positioning of said chill roll.

11. An improved chill roll apparatus used in connection with a printing process for setting ink to a web of paper by replacing solvent fumes, inks and printing residue moving with said web in the barrier air layer of said web and cooling said web after ink and solvents have been applied to said web and subsequently heated, said apparatus comprising:

a frame, a first chill roll mounted to the frame to receive the web, a second chill roll, mounted to the frame above the web travelling to said first chill roll, to receive the web from said first chill roll, said second chill roll positioned so that the web wrapping around said second chill roll coacts with the web travelling in the opposite direction and being received by said first chill roll to create a zone of interference to significantly replace said barrier layers of air containing ink solvents and printing residue with clean ambient air for preventing said barrier layers of air containing ink solvents and printing residue from adhering to the surface of said first chill roll, a third chill roll, mounted to the frame above the web travelling from said first chill roll to said second chill roll, to receive the web from said second chill roll, said third chill roll positioned so that the web wrapping around said third chill roll coacts with the web travelling in the opposite direction from said first chill roll to said second chill roll to create a zone of interference to significantly replace said barrier layers of air containing ink solvents and printing residue with clean ambient air for preventing said barrier layers of air containing ink solvents and printing residue from adhering to the surface of said first chill roll, drive means mounted on said frame and associated with said chill rolls for rotating said rolls to cause said web to move through said apparatus in contact with said chill roll, and cooling means associated with said rolls for cooling said heated web to set the ink to said web.

12. The improved chill roll apparatus of claim 11 wherein said second and third chill rolls are adjustably mounted to said frame to provide vertical adjustable positioning of said chill rolls to thereby allow variable scrubbing and cleaning of said barrier layers and to further allow variable cooling of said web.

13. The improved chill roll apparatus of claims 11 or 12, further comprising a fourth chill roll mounted to said frame above the web travelling from said second chill roll to said third chill roll to receive the web from said third chill roll, said fourth chill roll positioned so that the web wrapping around said fourth chill roll coacts with the web travelling in the opposite direction from said second chill roll to said third chill roll to create a zone of interference to significantly replace said barrier layers of air containing solvent fumes, inks and printing residue with clean ambient air for preventing said barrier layers of air containing solvent fumes, inks and printing residue from adhering to the surface of said third chill roll.

14. The improved chill roll apparatus of claim 13 wherein said fourth chill roll is adjustably mounted to said frame to provide vertical positioning of said chill roll.

15. An improved chill roll apparatus used in connection with a printing process for setting ink to a web of paper by removing solvent fumes moving with said web in the barrier air layer of said web and cooling said web after ink and solvents have been applied to said web and subsequently heated, said apparatus comprising:

a frame, a plurality of chill rolls mounted on said frame, drive means mounted on said frame and associated with said rolls for rotating said rolls to cause said web to traverse a first chill roll, travel a distance to a second chill roll, traverse said second chill roll, travel a distance to at least a third chill roll, and traverse said third chill roll, cooling means associated with said rolls for cooling said heated web to set the ink to said web, and a first and second scrubbing means for significantly replacing said solvent fumes, inks and printing residue suspended in said barrier layers of air with clean ambient air for preventing said solvent fumes, inks and printing residue from adhering to said web, said first scrubbing means defined by the interaction of said web traversing said second chill roll and the movement of said web to said first chill roll in the opposite direction, said second scrubbing means defined by the interaction of said web traversing said third chill roll and the movement of said web from said first chill roll to said second chill roll in the opposite direction.

16. The improved chill roll apparatus of claim 15 wherein said second and third chill rolls are adjustably mounted to said frame to provide vertical adjustable positioning of said chill rolls to thereby allow variable scrubbing and cleaning of said barrier layers and to further allow variable cooling of said web.

17. The improved chill roll apparatus of claim 15, further comprising a fourth chill roll mounted to said frame to receive said web after said third chill roll and a third scrubbing means for significantly replacing said solvent fumes, inks and printing residue suspended in said barrier layers of air with clean ambient air for preventing said solvent fumes, inks and printing residue from adhering to said web, said third scrubbing means defined by the interaction of said barrier layer adhering to the exterior of said web traversing said fourth chill roll and said barrier layer adhering to said web travelling from said second chill roll to said third chill roll in the opposite direction.

18. The improved chill roll apparatus of claim 17 wherein said fourth chill roll is adjustably mounted to said frame to provide vertical positioning of said chill roll.

19. The improved chill roll apparatus of claim 16, further comprising a fourth chill roll mounted to said frame to receive said web after said third chill roll and a third scrubbing means for removing solvent fumes, inks and printing resins, said third scrubbing means defined by the interaction of said barrier layers adhering to said web traversing said fourth chill roll and said barrier layers adhering to said web travelling from said second chill roll to said third chill roll in the opposite direction.

20. The improved chill roll apparatus of claim 19 wherein said fourth chill roll is adjustably mounted to said frame to provide vertical positioning of said chill roll.

* * * * *

UNITED STATES PATENT AND TRADEMARK OFFICE

CERTIFICATE OF CORRECTION

PATENT NO. : 4,774,771

DATED : October 4, 1988

INVENTOR(S) : Francis J. Littleton

It is certified that error appears in the above-identified patent and that said Letters Patent is hereby corrected as shown below:

Column 5, line 20, "44" should be --4-4--.

Column 5, between FIG. 4 on line 20 and FIG. 6 on line 21, add --FIG. 5 is a cross-sectional view of the chill rolls and web of the present invention schematically showing the second and third chill rolls eccentrically mounted to the frame.--

Column 12, line 16, before the word "rolls" add --chill--.

Column 12, line 56, before the word "rolls" add --chill--.

Column 13, line 28, change "resins" to --residue--.

Column 13, line 56, after the word "ink" add --,--.

Column 13, line 58, after the word "ink" add --,--.

Column 13, line 68, after the word "ink" add --,--.

Column 14, line 2, after the word "ink" add --,--.

Column 14, line 9, before the word "rolls" add --chill--.

Column 14, line 49, before the word "rolls" add --chill--.

Column 14, the paragraph on lines 57-60 and the paragraph on lines 61-64 should be sub-paragraphs to the paragraph beginning on line 51.

UNITED STATES PATENT AND TRADEMARK OFFICE

CERTIFICATE OF CORRECTION

PATENT NO. : 4,774,771

DATED : October 4, 1988

INVENTOR(S) : Francis J. Littleton

It is certified that error appears in the above-identified patent and that said Letters Patent is hereby corrected as shown below:

Column 16, line 7, change "resins" to --residue--.

Signed and Sealed this

Eleventh Day of April, 1989

*Attest:*

DONALD J. QUIGG

*Attesting Officer*

*Commissioner of Patents and Trademarks*